US005560426A

United States Patent [19]

Trahan et al.

[11] Patent Number: 5,560,426

[45] Date of Patent: Oct. 1, 1996

[54] DOWNHOLE TOOL ACTUATING MECHANISM

[75] Inventors: Kevin O. Trahan; John L. Baugh, both of Houston, Tex.

[73] Assignee: Baker Hughes Incorporated, Houston, Tex.

[21] Appl. No.: 411,502

[22] Filed: Mar. 27, 1995

[51] Int. Cl.[6] ..... E21B 23/01

[52] U.S. Cl. ..... 166/120; 166/182; 166/207

[58] Field of Search ..... 166/182, 120, 166/207, 213, 217

[56] References Cited

U.S. PATENT DOCUMENTS

| | | | |
|---|---|---|---|
| 2,718,926 | 9/1955 | Schlegel | 166/182 |
| 3,776,307 | 12/1973 | Young | 166/207 X |
| 3,897,823 | 8/1975 | Ahlstone | 166/182 X |
| 4,397,351 | 8/1983 | Harris | 166/182 X |
| 4,508,167 | 4/1985 | Weinberg et al. | 166/120 |
| 4,730,835 | 3/1988 | Wilcox et al. | 166/120 X |
| 4,742,874 | 5/1988 | Gullion | 166/182 X |

*Primary Examiner*—Frank Tsay
*Attorney, Agent, or Firm*—Rosenblatt & Redano P.C.

[57] ABSTRACT

The invention relates to actuation of a downhole tool by hydraulic forces in a structure that does not employ lateral openings through the wall of the tool. By a variety of mechanisms, the tool wall is urged to flex preferably within its elastic limits. The wall flexing either signals a sensor which senses such motion to create a corresponding signal which can unlock a piston. Thereafter, hydraulic pressure differences are employed to move the piston to operate the downhole tool.

23 Claims, 5 Drawing Sheets

DOWNHOLE TOOL ACTUATING MECHANISM

FIELD OF THE INVENTION

The field of this invention relates to downhole tools, particularly actuating mechanisms for downhole tools.

BACKGROUND OF THE INVENTION

There are numerous types of downhole tools available. Some use slips to secure their position, which are in turn actuated by movement of a sleeve. Yet other tools perform different functions, such as opening and closing valves or ports responsive to the motion of the tool or hydraulic actuation of a piston. In the realm of hydraulically actuated tools in particular, pressure build-up inside or outside the tool was generally required. That pressure communicated through a wall of the tool into a sealed chamber. The actuating piston would form part of the sealed chamber such that the cavity would grow or shrink in volume as the piston moved responsive to the increase or decrease of hydraulic pressure within the tool. These variable-volume cavities outside the wall of the tool were sealed off with elastomeric O-rings or similar seals. These seals were subject to wear from contamination in wellbore fluids, stroking back and forth in normal operation, and/or temperature or chemical effects from the wellbore fluids. The concern that such sealing elements would wear out was that an open channel would be created through the lateral port in the wall of the tool from inside to outside of the tool, thus upsetting well operations and costing critically expensive downtime for the well operator.

The apparatus of the present invention was developed to address these concerns. The apparatus employs the principles of pressure differential but without fluid communication. Instead, the applied pressure differential creates a stress which allows the wall of the tool to flex preferably within its elastic limits. The flexing can then be employed to either create a signal which indirectly causes the tool to actuate, or to directly cause the tool to actuate by employing such techniques as hydrostatic pressure differentials.

SUMMARY OF THE INVENTION

The invention relates to actuation of a downhole tool by hydraulic forces in a structure that does not employ lateral openings through the wall of the tool. By a variety of mechanisms, the tool wall is urged to flex preferably within its elastic limits. The wall flexing either signals a sensor which senses such motion to create a corresponding signal which can unlock a piston. Thereafter, hydraulic pressure differences are employed to move the piston to operate the downhole tool.

DETAILED DESCRIPTION OF THE PREFERRED EMBODIMENT

Figure 1A:
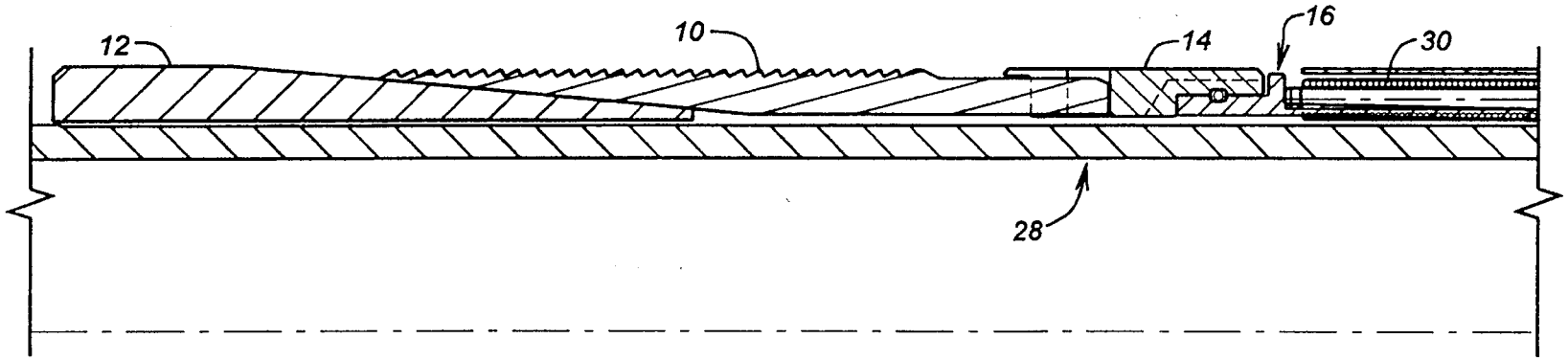
FIGS. 1*a*–1*b* illustrates the preferred embodiment of the tool in the run-in position, with an alternative actuating mechanism in dashed lines.
Figure 1B:
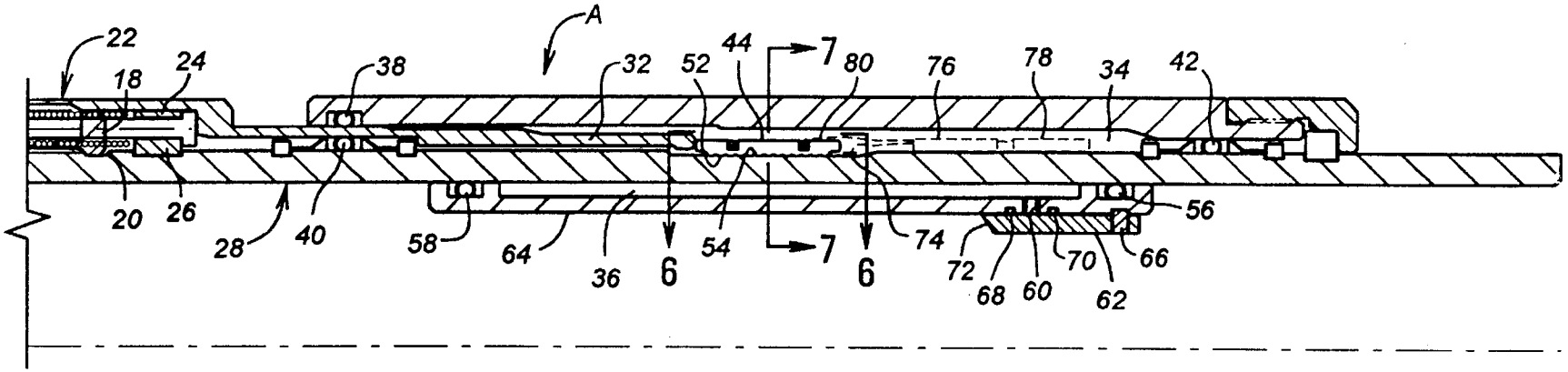
Figure 3A:
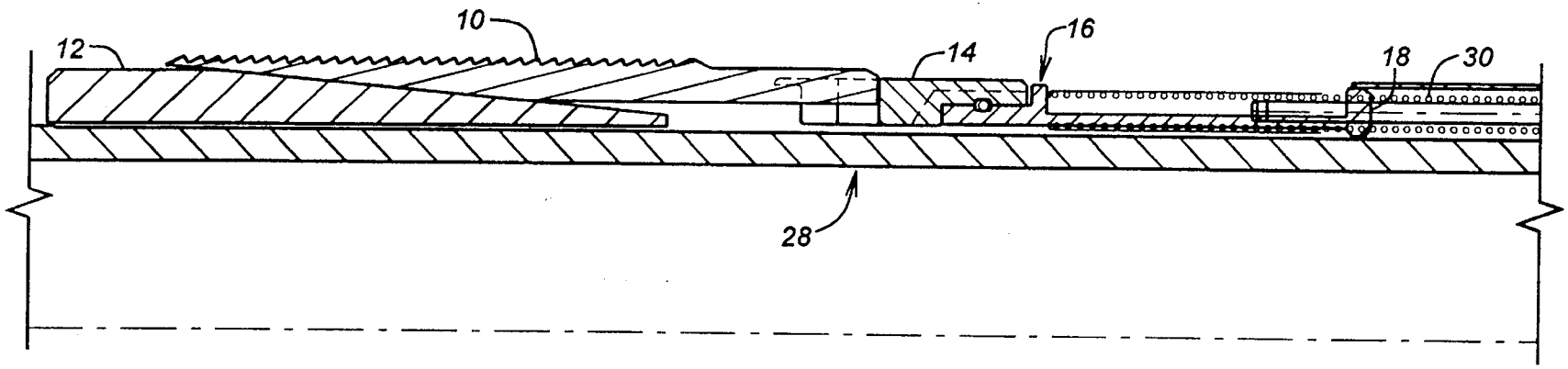
FIGS. 3*a*–3*b* is the tool of FIG. 2 in the fully set position.
Figure 3B:
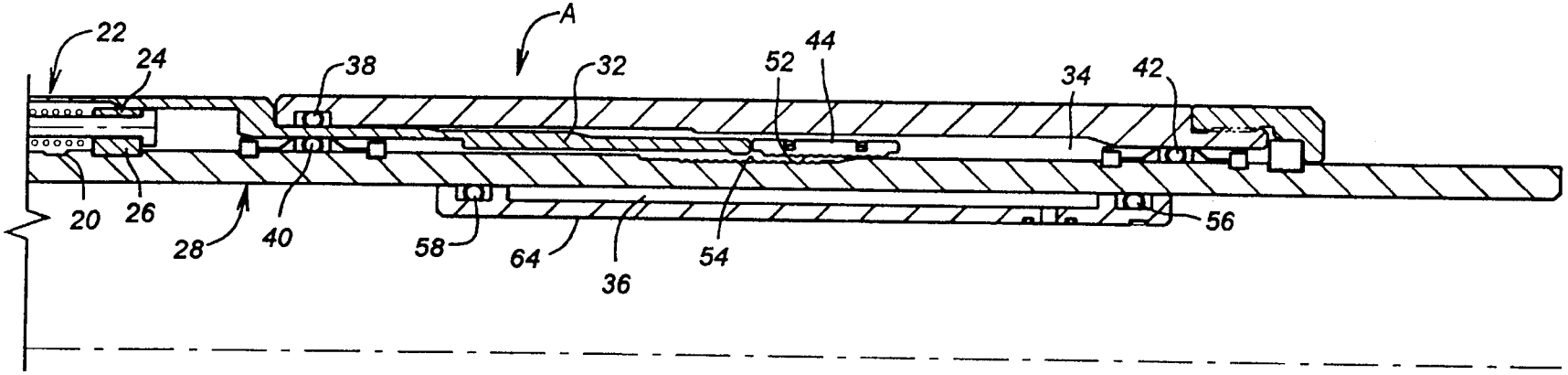

The apparatus A is illustrated in FIG. 1. While many different types of downhole tools can be used in conjunction with the setting mechanism illustrated, FIG. 1 in particular shows a mechanism for setting a series of slips 10 by pushing them along a cone 12. In the run-in position shown in FIG. 1, the slips 10 are retracted to facilitate the insertion of the downhole tool in the wellbore. Ultimately, as can be seen by comparing FIG. 1 and FIG. 3, the slips 10 will be driven up the sloping surface of cone 12. The slips 10 are held by a retainer 14, which in turn abuts a piston assembly 16. Piston assembly 16 includes a lug 18, which in the run-in position is trapped in groove 20 by sleeve 22. Sleeve 22 has a surface 24 which abuts lug 18 on one end, while the other end of lug 18 is in groove 20, thus effectively trapping the piston assembly 16 from longitudinal movement. A support ring 26 is secured to the wall 28 of the apparatus A. The support ring 26 supports a spring 30, which, when the lug 18 is liberated by movement of sleeve 22, results in biasing the piston 16 in a manner which will drive the slips 10 up the cone 12, as shown in FIG. 3.

Piston assembly 16 has an extending segment 32 which extends into chamber 34. The pressure in chamber 34 is preferably atmospheric, but can be a different pressure up to near the annulus pressure. Chamber 36 is disposed on the opposite side of wall 28 from chamber 34, and in the preferred embodiment should have a pressure in it the same as or slightly different from chamber 34. Extending segment 32 is movably mounted between seals 38 and 40. Seal 42 rounds out all the seals required to contain a predetermined pressure in cavity 34 during run-in.

Figure 7:
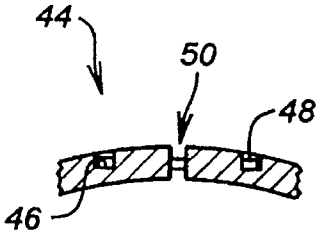
FIG. 7 is the view along line 7—7 of FIG. 1.
Figure 6:
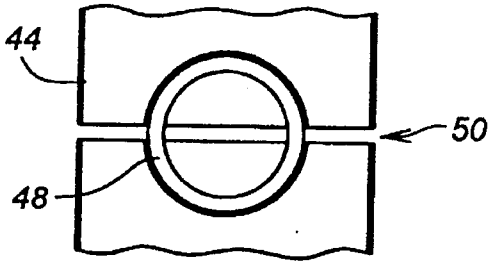
FIG. 6 is the view along line 6—6 of FIG. 1.
Figure 9:
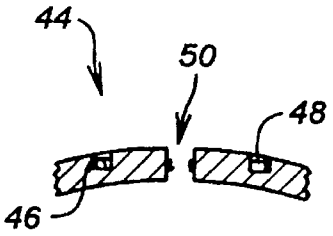
FIG. 9 is the view along line 9—9 of FIG. 2.
Figure 8:
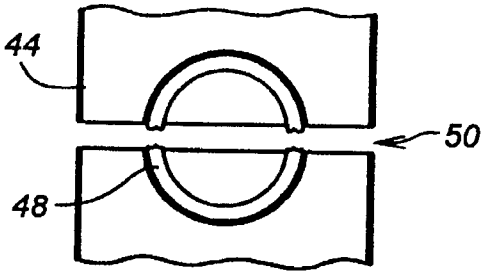
FIG. 8 is the view along line 8—8 of FIG. 2.
Figure 4:
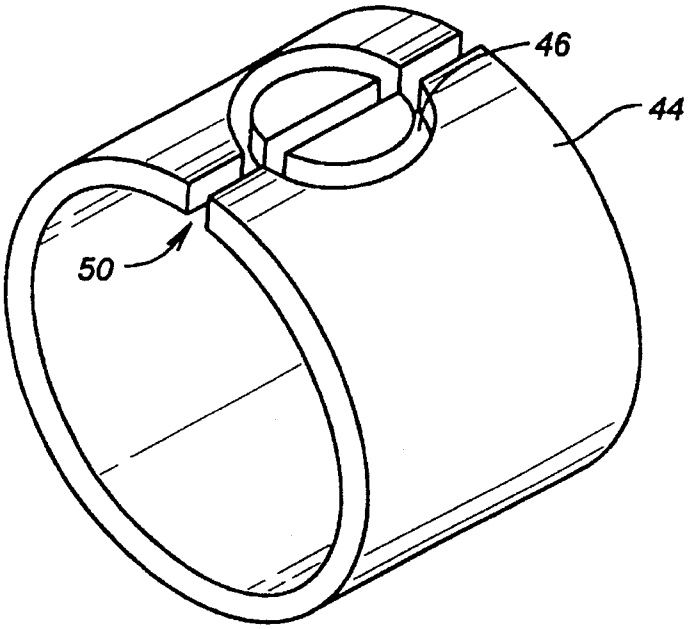
FIG. 4 is a perspective view of the lock ring which is liberated upon wall flexing.

Since the hydrostatic pressure acting on piston assembly 16 in the wellbore exceeds the opposing pressure exerted on extending segment 32 within cavity 34, piston assembly 16 tends to want to move downwardly against lock ring 44. In the preferred embodiment, lock ring 44 is shown in perspective view in FIG. 4 to be a split ring with a circular groove 46. In the preferred embodiment, a frangible member 48 (see FIG. 7) secures the circular groove 46 as one continuous groove, thus reducing the gap 50 (see FIG. 4) to nearly zero when fully assembled as shown in FIG. 6. When the split lock ring 44 is assembled over the wall 28, it has an internal thread 52 which engages a thread 54 on wall 28, thus affixing the position of lock ring 44 to the wall 28 and, in turn, effectively preventing movement of piston assembly 16.

Disposed on the other side of wall 28 is cavity 36, which is formed between seals 56 and 58. The internal cavity 36 has a port 60 which is sealingly covered by breakaway sleeve 62, which is held to ring 64, which forms cavity 36, by a shear pin or other equivalent frangible mechanism 66. Seals 68 and 70 seal between the ring 64 and breakaway sleeve 62 around the port 60. In the preferred embodiment, the initial pressure of chambers 34 and 36 is atmospheric upon assembly at the surface. However, different pressures than atmospheric in those two chambers can be used without departing from the spirit of the invention. The objective is to keep the wall 28 in the area of threads 54 from prematurely flexing due to significant pressure differential before the desired time.

Figure 2A:
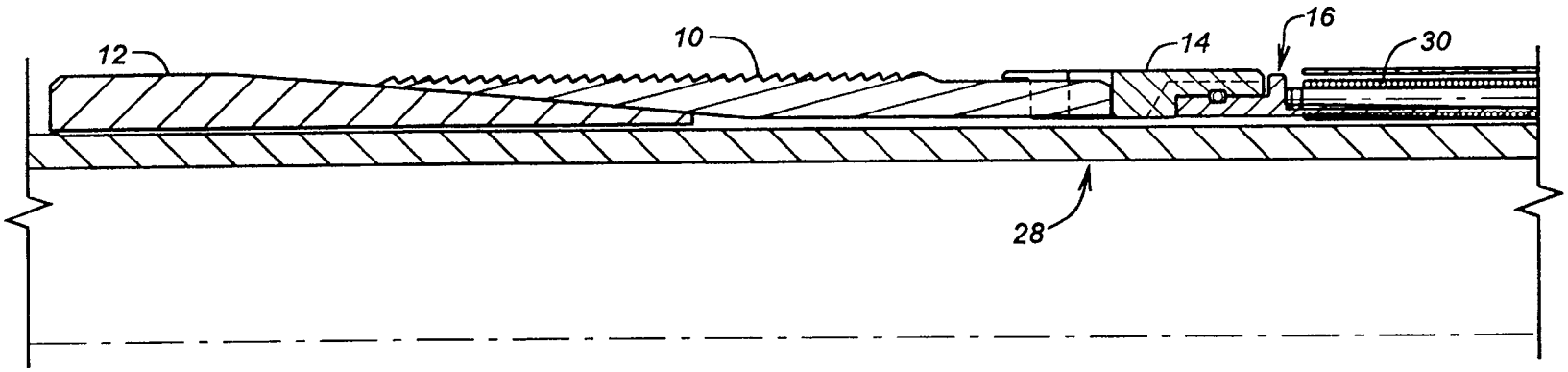
FIGS. 2*a*–2*b* is the view of FIG. 1 in the position where the wall has flexed.
Figure 2B:
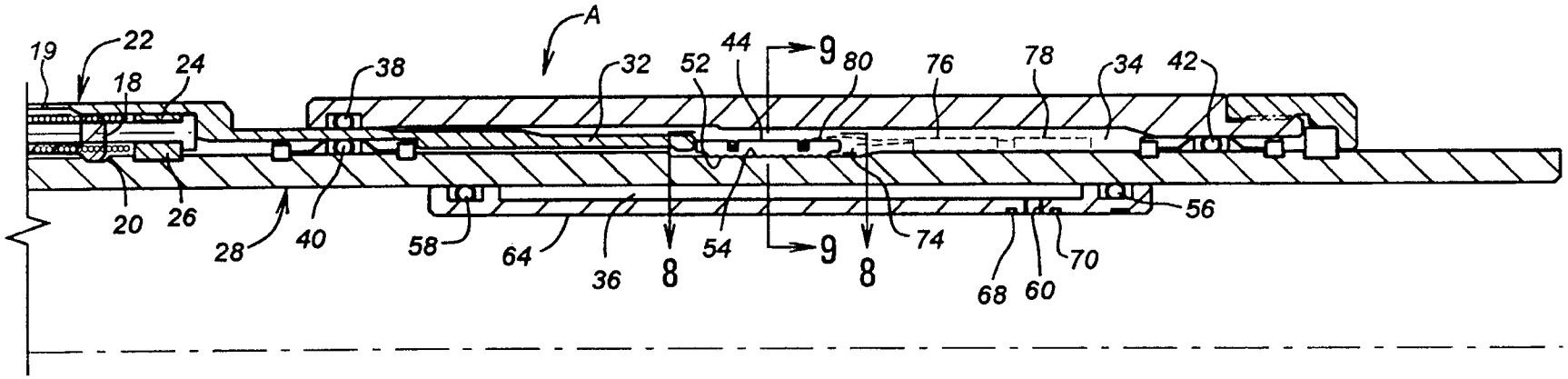

Referring now to FIG. 2, the position of the components after the wall has flexed is illustrated. In order to initiate the wall flexing, a sphere or other object is dropped into the apparatus A and scalingly lands against the breakaway sleeve 62 on a seat 72. Once the internal passageway of the apparatus A is sealed off against seat 72, applied pressure from the surface breaks shear pin 66 and causes the breakaway sleeve 62 to move downhole. The port 60 is now exposed to hydrostatic pressures within the wellbore. The pressure in cavity 36 begins to build up. Since at the same time the pressure in cavity 34 across the wall 28 from cavity 36 is at a significantly lower pressure, elastic flexing movement of wall 28 occurs in the vicinity of threads 54. This flexing action puts an increasing hoop stress on lock ring 44, causing gap 50 to increase to the point where the frangible member 48, which can be preferably of a ceramic material, breaks. Once the ceramic member 48 breaks, the gap 50 grows to the point where the threads 52 disengage from threads 54. Since the piston assembly 16 is in a pressure imbalance and the pressure internally in cavity 34 is significantly lower than the hydrostatic pressure in the annulus outside the apparatus A, the piston assembly 16 shifts further into the chamber 34, as illustrated in FIG. 3. Once sufficient movement into chamber 34 has resulted in a liberation of lug 18, spring 30 moves the piston assembly 16 upwardly, thus camming the slips 10 up the cone 12. Lug 18 is freed when surface 19, rather than surface 24, presents itself opposite lug 18. It should be noted that the breakaway sleeve 62 can be displaced only a sufficient amount to open the port 60 to hydrostatic pressures within the apparatus A and can still be retained by the apparatus A or can be completely dislodged from the apparatus A to move further downhole, as shown in these figures. Alternatively, any mechanism to allow pressure build-up in cavity 36 is within the scope of the invention. Movement of piston assembly 16 can also be used to accomplish any other downhole operation.

Figure 5:
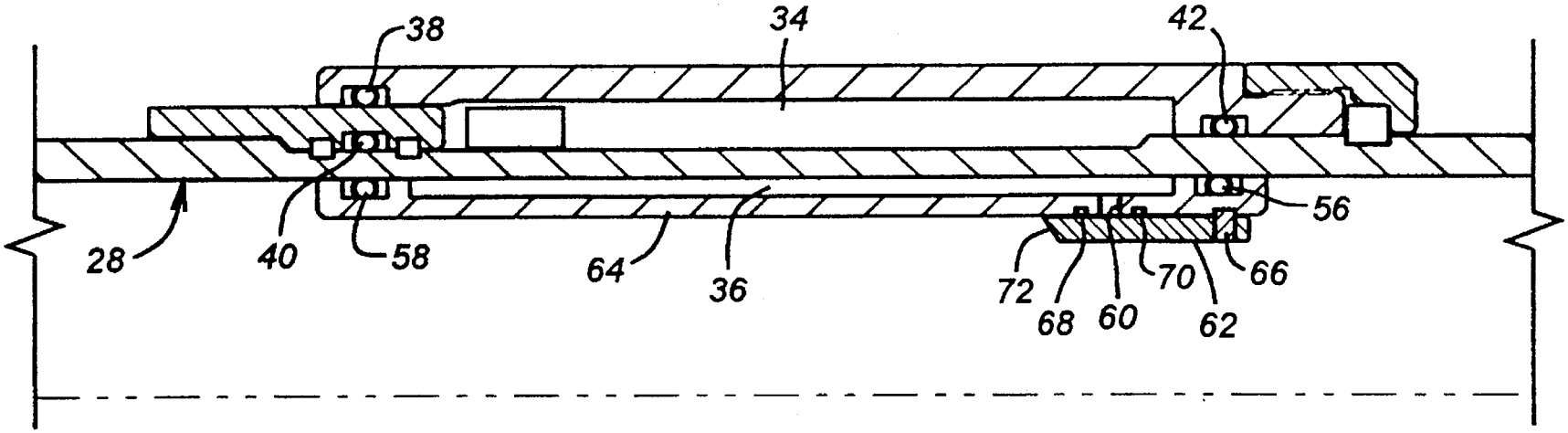
FIG. 5 is a schematic representation showing the layout of the chambers that can be used to initiate wall flexing.

An alternative way to liberate the grip of lock ring 44 onto wall 28 is illustrated in dashed lines in FIG. 1. There, a strain gauge or gauges 74 senses wall flexing. The strain gauge or gauges 74 are connected to control circuitry 76, which is powered by a battery pack 78. In this version, instead of using a frangible element such as a ceramic for a ring 48, a plastic cord such as Kevlar®, made by DuPont, is substituted for the ceramic ring 48 to hold ring 44 in the position of FIG. 1. Alternatively, the lock ring 44 can be differently configured with a split and circumferential grooves in which the Kevlar® can be disposed. A nichrome wire 80 can be interlaced with the Kevlar® that holds the lock ring 44 together, keeping the gap 50 as small as possible. A possible layout using Kevlar® is illustrated in detail in a related application owned by Baker Hughes filed in the U.S. on Oct. 20, 1994 and having Ser. No. 08/326,824. The details of such application are to any extent necessary fully incorporated by reference in this application as if fully set forth herein. Upon receipt of the proper signal at the strain gauges 74, the battery pack 78, in conjunction with the control circuit 76, sends an electrical current through the nichrome wire 80, which in turn heats the Kevlar® element or elements 48 until they weaken sufficiently to snap or break, thus allowing the gap 50 to grow to the point where the grip of threads 52 and 54 is released. Thereafter, in the manner previously described, the piston assembly 16 is free to move, thus allowing the downhole tool of the present invention to actuate. In the schematic representation shown in FIG. 5, those skilled in the art will appreciate that different mechanisms or signals can be generated responsive to all flexing to accomplish the operation of the downhole tool, all without holes in the walls 28 of the tool. Thus, different types of tools can be used, such as on/off valves, slips, liner hangers, and the like, all of which could be actuated in this manner without presenting a risk to the operator of a leak through the wall of the downhole system which would allow undesirable communication between the annulus and the tubing in the wellbore. The purely mechanical system as initially described is preferred because it better withstands the hostile downhole environments. The electrical embodiment which has been described has certain temperature limits for the battery pack and the electronic circuitry enclosed within the chamber 34. The mechanical system using the frangible member 48 has significantly higher operational capabilities insofar as its insensitivity to well fluid temperature or composition.

The foregoing disclosure and description of the invention are illustrative and explanatory thereof, and various changes in the size, shape and materials, as well as in the details of the illustrated construction, may be made without departing from the spirit of the invention.

We claim:

1. A tool for performing a downhole operation from the surface, comprising:

a tubular body forming a wall, said wall having an interior which defines a passage therein and an exterior which, when placed in the wellbore, defines an annular space therewith;

an actuating member movable mounted to said body for performing the downhole operation;

a locking member mounted to said body to selectively prevent motion of said actuating member until said locking member is unlocked responsive to wall flexing of said tubular body.

2. The tool of claim 1, wherein:

said actuating member is mounted to the exterior of said body;

said locking member is also mounted to the exterior of said body;

whereupon internal pressure build-up in said passage of said body, a segment of said tubular body flexes outwardly to unlock said locking member.

3. The tool of claim 2, wherein:

said wall of said tubular body has no opening extending therethrough from said passage, and said pressure build-up to initiate said wall flexing occurs substantially within said body.

4. The tool of claim 3, further comprising:

at least two opposed sealed first and second chambers, with said first chamber on said interior of said wall and said second chamber on said exterior of said wall and adjacent to said locking member;

said first chamber in said passage within said body selectively accessible to pressure in said passage to create a pressure imbalance across said wall as between said first and second chambers, to flex said wall.

5. The tool of claim 4, wherein:

said locking member is a split ring held in a locked position to the exterior of said wall by a frangible member;

said flexing of said wall expands said locking member until said frangible member breaks to release the locking member from said wall exterior.

6. The tool of claim 5, wherein:

said split ring comprises a passage to accommodate said frangible member that spans said split thereon, whereupon assembly to said wall exterior, said frangible member forcibly retains said split ring over said wall exterior until said frangible member breaks, allowing said split ring to re-expand to lose its grip on said exterior of said wall.

7. The tool of claim 6, wherein:

said frangible member is a ring and said passage in said split ring is circular and spans said split in said split ring to accommodate said frangible ring.

8. The tool of claim 7, wherein:

said wall exterior and an abutting interior surface of said ring have conforming surfaces to facilitate longitudinal fixation of said split ring until said flexing of said wall breaks said frangible member.

9. The tool of claim 4, wherein:

said actuating member is selectively held by said locking member against a force imbalance thereon;

said actuating member extends into said second chamber on said exterior of said wall and abuts said locking member which prevents movement thereof due to a hydraulic force imbalance acting on said actuating member from forces internally and externally of said second chamber;

whereupon flexing of said wall, said locking member is defeated to allow said force imbalance to move said actuating member.

10. The tool of claim 9, further comprising:

an access port in a sleeve which defines said first chamber;

a cover for said access port selectively removable from the surface to unseal said first chamber and allow an increase in press chamber to initiate flexing of said wall.

11. The tool of claim 10, wherein:

said cover is formed having a seat;

said tool further comprising an object which has a shape that allows it to scalingly engage said scat when moved into contact with said scat in said tubular body;

said cover is sealingly retained over said access port by a frangible member which breaks on pressure build-up when said object obstructs said passage by contacting on said seat.

12. The tool of claim 8, wherein:

said actuating member is selectively held by said locking member against a force imbalance thereon;

said actuating member extends into said second chamber on said exterior of said wall and abuts said locking member which prevents movement thereof due to a hydraulic force imbalance acting on said actuating member from forces internally and externally of said second chamber;

whereupon flexing of said wall, said locking member is defeated to allow said force imbalance to move said actuating member.

13. The tool of claim 12, further comprising:

an access port in a sleeve which defines said first chamber;

a cover for said access port selectively removable from the surface to unseal said first chamber and allow an increase in pressure in said first chamber to initiate flexing of said wall.

14. The tool of claim 13, wherein:

said cover is formed having a seat;

said tool further comprising an object which has a shape that allows it to sealingly engage said seat when moved into contact with said seat in said tubular body;

said cover is sealingly retained over said access port by a frangible member which breaks on pressure build-up when said object obstructs said passage by contacting on said seat.

15. The tool of claim 4, wherein:

said locking member is a split ring held in locking position to the exterior of said wall by a breakable member;

said chamber on said exterior of said wall further comprises:

means responsive to said wall flexing to break said breakable member, thereby unlocking said locking member.

16. The tool of claim 15, wherein said means responsive to said wall flexing further comprises:

at least one strain gauge connected to a control circuit powered by at least one battery;

said breakable member further comprises at least one cord binding said split ring to said exterior wall;

said circuit further comprises a heating element mounted to said cord which, when actuated by said circuit, causes said cord to break, allowing said split ring to release from said exterior of said wall.

17. The tool of claim 16, wherein:

said cord is made of a plastic material and said heating element comprises at least one nichrome wire attached thereto.

18. A tool for performing a downhole operation, comprising:

a tubular body defining a wall having an interior and exterior surface;

an actuating member mounted to said body, at least a portion of which extends into a sealed chamber formed at least in part by said wall;

a locking member mounted to said wall to prevent said actuating member from moving when it is under a force imbalance due to a pressure difference between inside and outside said chamber;

said locking member subject to being defeated to allow said actuating member to move responsive to flexing said wall.

19. The tool of claim 18, wherein:

said chamber is mounted on the exterior face of said wall;

said wall flexing is accomplished by pressure build-up against said interior face without flow communication through said wall.

20. The tool of claim 19, further comprising:

an interior chamber in said body opposite said wall from said sealed chamber to hold the wall section therebetween in pressure balance downhole;

means for introducing increased pressure in said interior chamber to upset said pressure balance and induce said wall flexing.

21. The tool of claim 20, wherein:

said locking member comprises a split ring held over said exterior face by a frangible member which breaks responsive to said wall flexing to defeat said locking member.

22. The tool of claim 4, wherein:

said chambers contain fluid therein under substantially the same pressure, independent of depth of placement of said body in the wellbore, until said chamber within said passage is exposed to wellbore hydrostatic pressure.

23. The tool of claim 20, wherein:

said chambers contain fluid therein under substantially the same pressure, independent of depth of placement of said body in the wellbore, until said interior chamber is exposed to wellbore hydrostatic pressure.

* * * * *